US006793431B1

(12) United States Patent
Tsai

(10) Patent No.: US 6,793,431 B1
(45) Date of Patent: Sep. 21, 2004

(54) SQUEEZING DEVICE FOR A COSMETIC CONTAINER

(76) Inventor: Yi Li Tsai, P.O. Box 82-144, Taipei (TW)

( * ) Notice: Subject to any disclaimer, the term of this patent is extended or adjusted under 35 U.S.C. 154(b) by 0 days.

(21) Appl. No.: 10/630,671

(22) Filed: Jul. 31, 2003

(51) Int. Cl.[7] ..... B43K 5/06

(52) U.S. Cl. ..... 401/172; 401/171; 401/173; 401/206

(58) Field of Search ..... 401/171–174, 401/176, 179, 206, 205

(56) References Cited

U.S. PATENT DOCUMENTS 2,309,861 A * 2/1943 Mureau ..... 401/174
3,002,517 A * 10/1961 Pitton ..... 401/172
5,803,640 A * 9/1998 Nakajima et al. ..... 401/174
5,827,002 A * 10/1998 Nakajima ..... 401/174
5,851,079 A * 12/1998 Horstman et al. ..... 401/174
6,155,735 A * 12/2000 Nakajima ..... 401/172
6,227,739 B1 * 5/2001 Kageyama ..... 401/172
6,474,891 B1 * 11/2002 Liu ..... 401/174
6,688,796 B1 * 2/2004 Liu ..... 401/277
6,702,158 B2 * 3/2004 Kageyama et al. ..... 222/386

* cited by examiner

*Primary Examiner*—Gregory L. Huson
*Assistant Examiner*—Huyen Le
(74) *Attorney, Agent, or Firm*—Leong C. Lei

(57) ABSTRACT

A squeezing device for cosmetic is disclosed. The present invention relates to a container containing a make up cream or lotion, which can be squeezed out with a specific amount. The interior of the tubular body is mounted with a pushing rod, which is rotatably controlled by means of the screw threads on the pushing rod. The rotating seat rotates to push the pushing rod upward so that the make-up cream or lotion flows out. The outlet end is provided with an elastic valve plate for sealing so that the cream or the lotion steadily flows out and is automatically cut off.

4 Claims, 5 Drawing Sheets

SQUEEZING DEVICE FOR A COSMETIC CONTAINER

BACKGROUND OF THE INVENTION (a) Technical Field of the Invention

The present invention relates to a cosmetic container, and in particular, a container mounted with a squeezing device to deliver make up lotion or cream contained within the container in a specific amount.

(b) Description of the Prior Art

FIGS. 4 to 6 show a conventional cosmetic container having a tubular body 30 having a protruded interior and a stepped member at the bottom thereof. A pushing rod 31 is located within the interior and the top portion of the rod body is a valve plate 32 similar to the inner edge face of the tubular body 30. When the pushing rod 31 moves upward, the contained material within the interior of the container is squeezed out. The pushing rod 31 is provided in sequence a ratchet teeth seat 33 to guide an upward direction of the pushing rod 31, and the control of the upward movement is by means of a screw element 34. The tubular surface is constructed into a plurality of tubular faces, and in combination with a bottom ratchet teeth plate 35 mounted externally and together with a metallic spring 36, the top and bottom ratchet teeth faces are in engagement. The tubular face of the screw element 34 are directly inserted into the inner bottom portion of the bottom end rotating seat 37. The user can just rotate the rotating seat 37 so as to control the upward operation of the pushing rod 31. The top face of the tubular body has an outlet tube 40 and an absorption rod 41 mounted at the interior of the outlet end cap 42, such that the upward operation of the pushing rod 31 will cause the cosmetic to be squeezed out. The drawbacks of this conventional structure are that there are too many components and the constructions and assembling are not convenient, which increase the cost of production.

Besides, the output end is opened, the absorption rod 41 may contain too much of the make-up solution or cream, which will lower the pressure within the space contained the cosmetic and the subsequent rotating may not deliver cosmetic.

SUMMARY OF THE INVENTION

Accordingly, it is an object of the present invention to provide a squeezing device for a cosmetic container, characterized in that the screw member engaged at the engaging ring face of the inner edge of the tubular body for positioning. The recessed ring face allows a plastic ring element to pass through, and the bottom portion of the plastic ring element is mounted to the interior of a rotating seat. From the bottom section of the center of the rotating seat, a positioning rod is protruded outward. The cross sectional of the positioning rod is similar to the hollow slot of the pushing rod or have the corresponding engaging ring face such that it commends to the bottom end of the pushing rod inserted into the interior of the slot, so that when the rotating seat rotates, the pushing rod can be rotatably controlled. The top end of the plastic ring element is reserved with a ratchet face, which corresponds to the ratchet ring face of the screw member. By means of directional engagement of the ratchet teeth, the rotating seat can only perform the directional rotating operation. The top end opening of the tubular body is mounted with a material outlet end plug having an outlet edge which can be elastically engaged by a spherical shape valve plate so as to seal the entire outlet edge. The valve plate at the material outlet is provided with a plurality of through holes, forming into a passage for the squeezed material. The outer side is covered with a cap having net hole. Through the net hole and the hollow interior, together with the soft sponge surface layer on the cap, the rotating seat rotates will drive the pushing rod to move upward to squeeze out the cosmetic lotion/cream The valve plate moves upward to squeeze the material, when the pressure is larger than the elasticity of the arch-face of the valve plate, the valve plate will be deformed and the squeezing operation is attained.

Yet another object of the present invention is to provide a squeezing device for a cosmetic container, wherein the center of the rotating seat is protruded out with a positioning rod and the cross-sectional is similar to the hollow slot of the pushing rod or has a shape corresponding to the engaging side face.

Yet still another object of the present invention is to provide a squeezing device for a cosmetic container, wherein the valve plate contacts and seals the material outlet edge, and the circumferential edge is provided with through holes to form the passage for squeezing of cosmetics.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the all upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
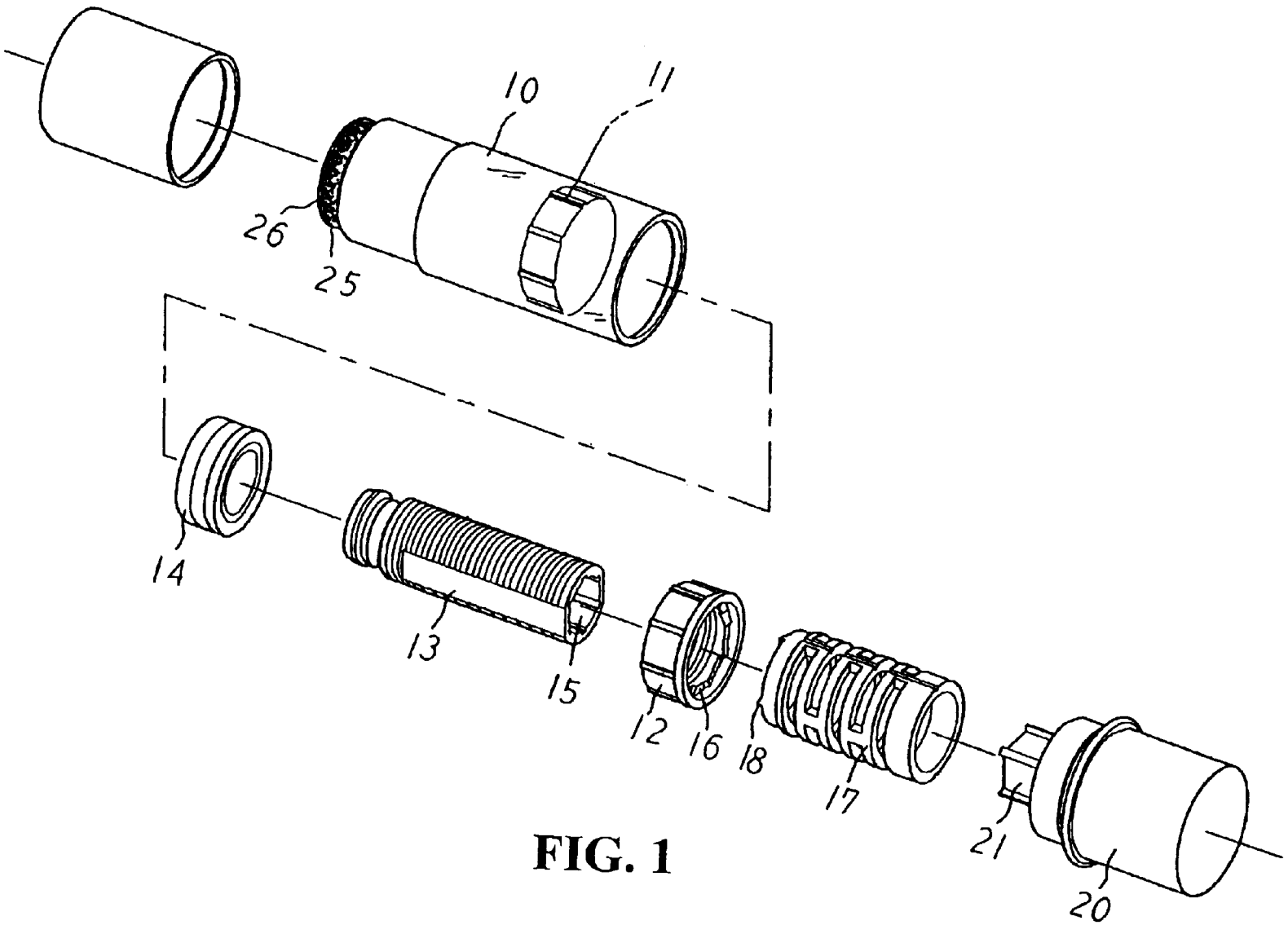
FIG. 1 is a perspective view of the container body in accordance with the present invention.
Figure 3:
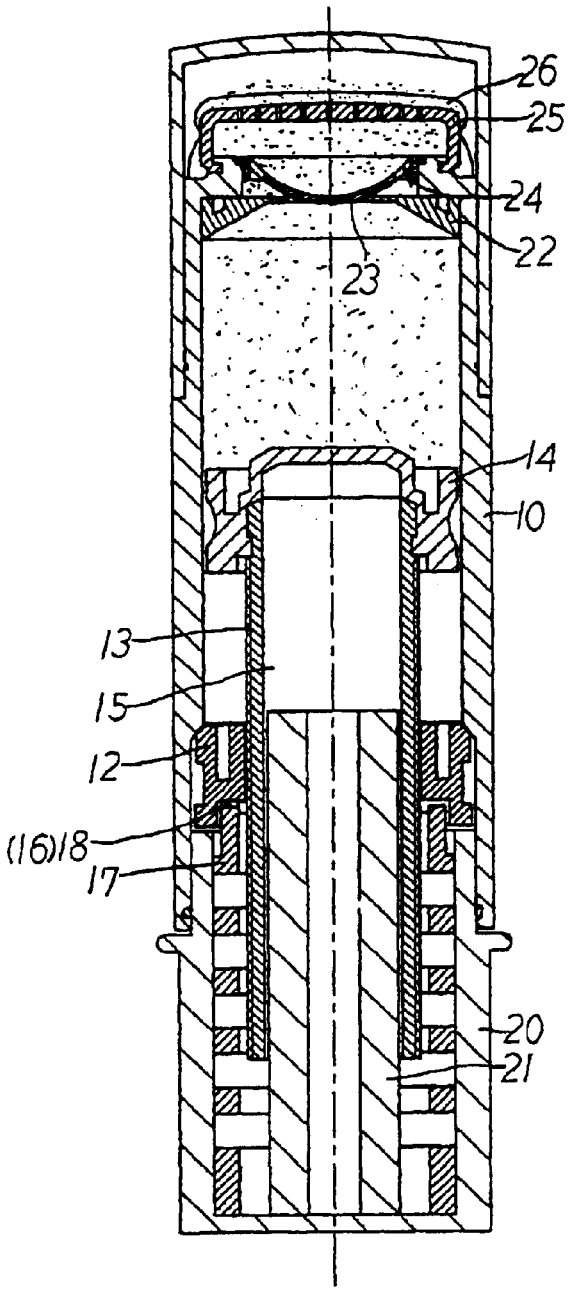
FIG. 3 is a schematic view showing the action of squeezing of the material from the container in accordance with the present invention.
Figure 2:
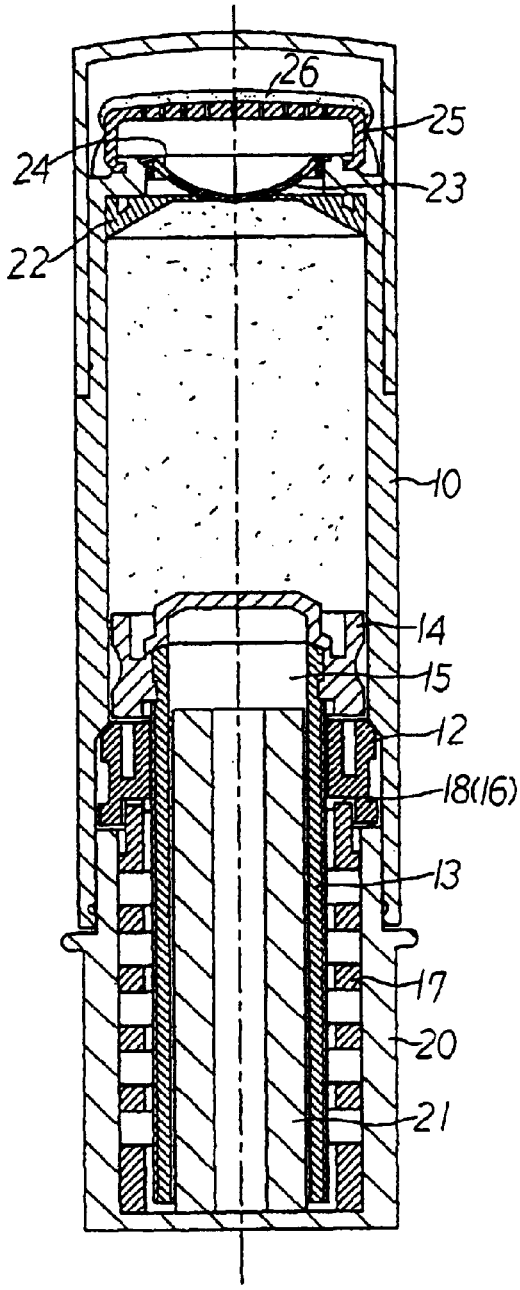
FIG. 2 is a plan view of the container structure in accordance with the present invention
Figure 4:
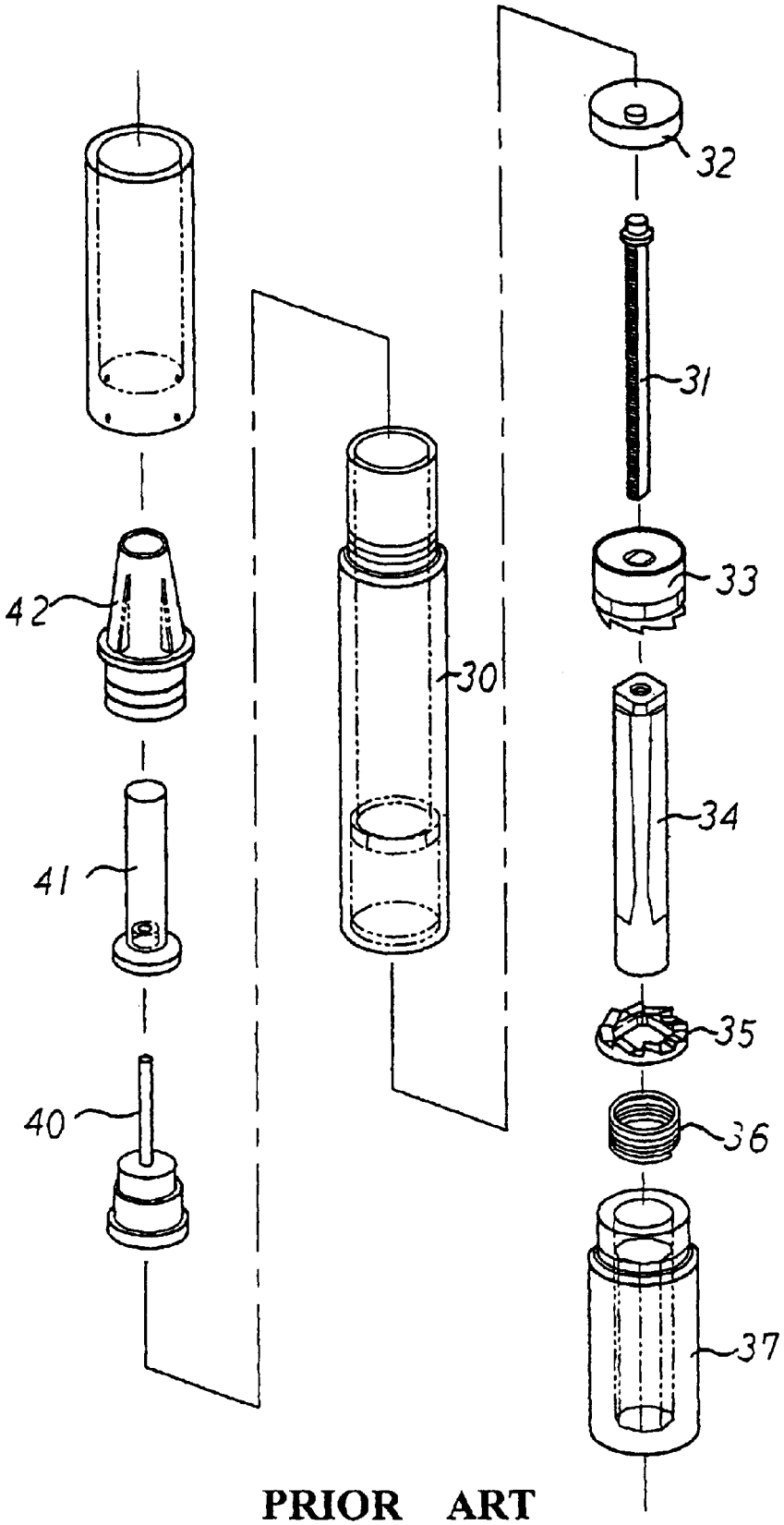
PRIOR ART FIG. 4
FIG. 4 is a perspective view of a conventional make-up container.
Figure 5:
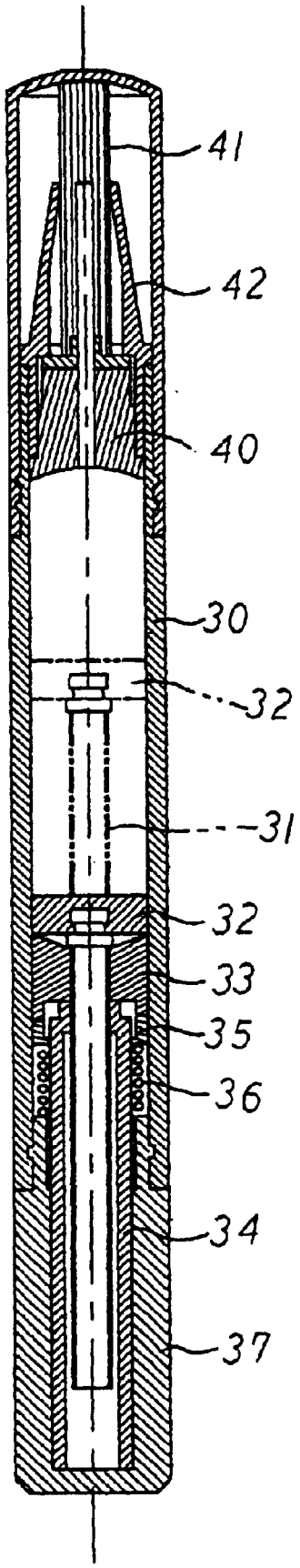
PRIOR ART FIG. 5
FIG. 5 is a plan view of a conventional make-up container.
Figure 6:
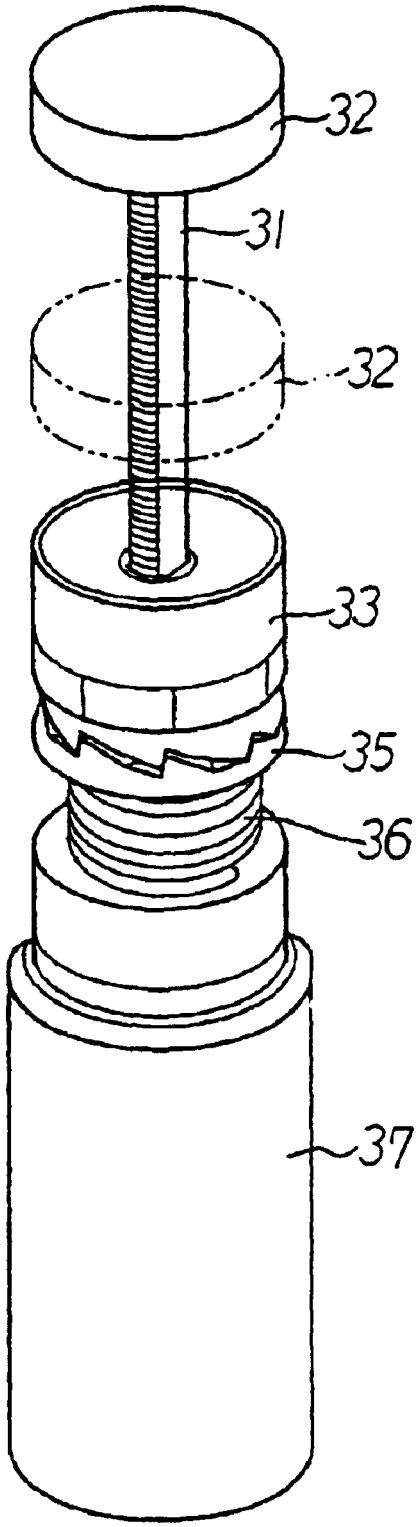
PRIOR ART FIG. 6
FIG. 6 is a schematic view showing the action of squeezing of the material from a conventional make-up container.

Referring to FIGS. 1 to 3, there is shown a squeezing device having a tubular body 10 for containing cosmetic lotion or creamy solution The inner tube edge of the body, close to the bottom portion thereof, is provided with an engaging ring face 11 constituted from a multiple or a plurality of protruded edges for engagement with a positioning screw member 12. On the member 12 there is a side face or protruded edge corresponding to the ring face 11 for easy positioning and mounting. Except for the screw hole at the center, the entire positioning screw 12 is used for installation of a pushing rod 13. The mounting end of the pushing rod 13 together with the pivotally mounted with a valve plate 14 having an internal diameter similar to that of the tubular body 10 is used for the controlling of the sliding of the tubular body 10 so as to achieve the function of squeezing of the contained cosmetic lotion/cream.

The rod body of the pushing rod 13 is provided with multiple edges of hollow positioning slots 15, the entire pushing operation is based on the screw member 12 engaged at the engaging ring face 11 of the inner edge of the tubular body 10 for positioning. The recessed ring face allows a plastic ring element 17 to pass through, and the bottom portion of the plastic ring element 17 is mounted to the interior of a rotating seat 20. From the bottom section of the center of the rotating seat 20, a positioning rod 21 is protruded outward. The cross sectional of the positioning rod 21 is similar to the hollow slot 15 of the pushing rod 13 or have the corresponding engaging ring face such that it corresponds to the bottom end of the pushing rod 13 inserted into the interior of the slot 15, so that when the rotating seat 20 rotates, the pushing rod-can be rotatably controlled. The top end of the plastic ring element 17 is reserved with a ratchet face 18, which corresponds to the ratchet ring face 16 of the screw member 12. By means of directional engagement of the ratchet teeth, the rotating seat 20 can only perform the directional rotating operation.

The top end opening of the tubular body 10 is mounted with a material outlet end plug 22 having an outlet edge which can be elastically engaged by a spherical shape valve plate 23 so as to seal the entire outlet edge. The valve plate 23 at the material outlet is provided with a plurality of through holes 24, forming into a passage for the squeezed material. The outer side is covered with a cap 25 having net hole. Through the net hole and the hollow interior, together with the soft sponge surface layer 26 on the cap, the rotating seat 20 rotates will drive the pushing rod 13 to move upward to squeeze out the cosmetic lotion/cream.

The valve plate 14 moves upward to squeeze the material, when the pressure is larger than the elasticity of the arch-face of the valve plate 23, the valve plate 23 will be deformed and the squeezing operation is attained. The squeeze material 23 will flow from the through hole 24 at the circumferential edge of the valve body 23 to the interior of the cap 25, and then overflow to the outer surface layer 26 for application of cosmetic.

In accordance with the present invention, by rotatably of the rotating seat 20, the pushing rod 13 is pushed in a specific direction and in combination with the engagement of the ratchet face 18, pressure leakage due to reverse rotate is avoided. Together with the elastic valve plate 23 at the material outlet edge at the top end which automatically restore to seal the material outlet the sealing effect of the interior material filing space is protected and the quantity of the cosmetic material is preserved. Further, the squeezing pressure from the interior is maintained constantly such that when application the cosmetics, a fixed amount of the cosmetic is delivered and this will facilitate the make-up procedure.

Due to the fact that the components of the entire structure are installed/connected as a compact structure, the size of the structure is greatly reduced. In particular, in combination with the plastic ring element 17, the structure is lightweight and it is recyclable.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A squeezing device for cosmetic container having a tubular body containing cosmetics and a rotating seat connected thereto, a positioning screw member positioned within the tubular body for connection with a pushing rod to control a ratchet member for uplifting and lowering of the push rod, and a rotating seat to push a spring of a bottom ratchet member, the rotating seat being used to rotatably control the push rod and the top end of the tubular body being a material outlet member, characterized in that the screw member engaged at a engaging ring face of the inner edge of the tubular body for positioning, a recessed ring face allows a plastic ring element to pass through, and the bottom portion of the plastic ring element is mounted to the interior of a rotating seat, from the bottom section of the center of the rotating seat, a positioning rod is protruded outward, the cross sectional of the positioning rod is similar to a hollow slot of the pushing rod or have the corresponding engaging ring face such that it corresponds to the bottom end of the pushing rod inserted into the interior of the slot, so that when the rotating seat rotates, the pushing rod can be rotatably controlled, the top end of the plastic ring element is reserved with a ratchet face, which corresponds to the ratchet ring face of the screw member, by means of directional engagement of the ratchet teeth, the rotating seat can only perform the directional rotating operation, the top end opening of the tubular body is mounted with a material outlet end plug having an outlet edge which can be elastically engaged by a spherical shape valve plate so as to seal the entire outlet edge, the valve plate at the material outlet is provided with a plurality of through holes, forming into a passage for the squeezed material, the outer side is covered with a cap having net hole, through the net hole and the hollow interior, together with a soft sponge surface layer on the cap, the rotating seat rotates will drive the pushing rod to move upward to squeeze out the cosmetic lotion/cream, the valve plate moves upward to squeeze the material, when the pressure is larger than the elasticity of the arch-face of the valve plate, the valve plate will be deformed and the squeezing operation is attained.

2. The device of claim 1, wherein the center of the rotating seat is protruded out with a positioning rod and the cross-sectional is similar to the hollow slot of the pushing rod or has a shape corresponding to the engaging side face.

3. The device of claim 1, wherein the valve plate contacts and seals the material outlet edge, and the circumferential edge is provided with through holes to form the passage for squeezing of cosmetics.

4. The device of claim 1, wherein the top surface layer of the structure is covered with a cotton sponge.

* * * * *